US009321086B2

(12) United States Patent
Zhao et al.

(10) Patent No.: US 9,321,086 B2
(45) Date of Patent: Apr. 26, 2016

(54) ULTRASONIC CLEANER AND COATER EQUIPPED WITH THE ULTRASONIC CLEANER

(71) Applicant: SHENZHEN CHINA STAR OPTOELECTRONICS TECHNOLOGY CO., LTD., Shenzhen, Guangdong (CN)

(72) Inventors: Guodong Zhao, Guangdong (CN); Tao Song, Guangdong (CN); Ming Liu, Guangdong (CN); Tao Ma, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 55 days.

(21) Appl. No.: 14/232,284

(22) PCT Filed: Aug. 6, 2013

(86) PCT No.: PCT/CN2013/080884

§ 371 (c)(1),
(2) Date: Jan. 13, 2014

(87) PCT Pub. No.: WO2015/003417

PCT Pub. Date: Jan. 15, 2015

(65) Prior Publication Data

US 2015/0174621 A1 Jun. 25, 2015

(30) Foreign Application Priority Data

Jul. 12, 2013 (CN) ..... 2013 1 0294069

(51) Int. Cl.

*B05B 15/02* (2006.01)
*B05B 7/06* (2006.01)
*B41J 2/165* (2006.01)
*B08B 3/12* (2006.01)

(52) U.S. Cl.

CPC ..... *B08B 3/12* (2013.01); *B05B 15/025* (2013.01); *B41J 2/16552* (2013.01); *B41J 2002/16567* (2013.01)

(58) Field of Classification Search

CPC ..... B05B 15/025
USPC ..... 118/313–315, 302, 304; 239/104, 106, 239/114, 115, 120, 121, 123; 134/184, 186; 222/148; 347/22–36

See application file for complete search history.

(56) References Cited

U.S. PATENT DOCUMENTS 6,676,242 B2 * 1/2004 Yun ..... 347/28
6,997,990 B2 * 2/2006 Bae et al. ..... 118/325
7,980,196 B2 * 7/2011 Kim et al. ..... 118/302

FOREIGN PATENT DOCUMENTS

JP 2013063411 A * 4/2013

* cited by examiner

*Primary Examiner* — Yewebdar Tadesse

(57) ABSTRACT

An ultrasonic cleaner and a coater equipped with the ultrasonic cleaner are provided. The ultrasonic cleaner is configured to clean an inkjet head for ejecting an alignment solution. The cleaner comprises a cleaning receiver for receiving a clean agent, an ultrasonic generator for generating an ultrasonic, and a storing device for retrieving and storing the clean agent, and each of the ultrasonic generator and the storing device is connected to the cleaning receiver. The ultrasonic cleaner can clean the blocked nozzle hole of the inkjet head quickly and thoroughly in a short time. Besides, the cleanliness in the equipment will not be destroyed and the cleaning agent can be retrieved.

4 Claims, 3 Drawing Sheets

ULTRASONIC CLEANER AND COATER EQUIPPED WITH THE ULTRASONIC CLEANER

FIELD OF THE INVENTION

The present invention relates to a coater used in optical process, and more particularly relates to an ultrasonic cleaner for cleaning an inkjet head of a coater and the coater equipped with the ultrasonic cleaner.

BACKGROUND OF THE INVENTION

In the field of manufacturing a liquid crystal display panel, an alignment solution generally needs to be coated uniformly on a CF (Color Filter) substrate or a TFT (Thin Film Transistor) substrate in accordance with a certain pattern to form an alignment film, so as to make the liquid crystal molecules align orderly under the effect of the alignment film. In the coating process for the alignment solution, with the development of equipments and the manufacturing technology, a method of plating the alignment solution is replaced by a method of spraying the alignment solution, in order to simplify the equipments and the manufacturing process and improve the productive capacity of the equipments and yield of the product. In the spraying process of the alignment solution, a whole line of inkjet heads are used to directly spray the alignment solution to the substrate; after the drops of the alignment solution naturally spread uniformly, the alignment solution is heated to volatilize the solvent in the alignment solution, and then an alignment film with a permanent thickness is formed.

Because the thickness (nano-sized) and uniformity of the alignment film needs to be controlled strictly, a single drop of the alignment solution is controlled to be tiny (nano-sized) during the spraying process of the alignment solution. Specifically, the method for making the drop tiny is as follows: firstly, compressing the alignment solution into the inkjet head under the pressure; secondly, applying a current to a piezoelectric ceramic (namely a vibrator) in the inkjet head to deform the piezoelectric ceramic to disgorge the alignment solution via a nozzle hole; finally, moving the inkjet head to produce drops of alignment solution with high density, so that the drops can spread under the surface tension to form a film.

At present, in the spraying process of the alignment solution, the nozzle hole of the inkjet head should be designed to be tiny-sized, since the single drip must be tiny. However, the traditional alignment solution usually comprises an organic solvent and an alignment polymer dissolved in the organic solvent, and the organic solvent is always volatile, the nozzle hole of the inkjet head will be easily blocked by the alignment polymer since the solvent is volatilized in the spraying process of the alignment solution. As a result, the equipment will be abnormal frequently and the quality of the product will be substantially reduced (normally the amount of the mura increases).

During the spraying process of the alignment solution, when the nozzle hole of the inkjet head is blocked, a user should scrub the inkjet head or put the nozzle hole of the inkjet head into the solvent to dissolve the alignment polymer. However, if the user scrubs the inkjet head, the cleanliness in the equipment will be destroyed. Besides, too much time will be consumed in these two cleaning methods, which may seriously reduce the productive efficiency and the productive quality. At the same time, if the equipment is cleaned in any of these two manners, the cleaning agent is hard to be retrieved, thus leading to the waste of the cleaning agent.

SUMMARY OF THE INVENTION

Aiming at the drawbacks in the prior art that the traditional methods for cleaning an inkjet head destroy the cleanliness in the equipment, consume much time, and seriously affect the productive efficiency, the object of the present invention is to provide an ultrasonic cleaner and a coater equipped with the ultrasonic cleaner, which can clean the blocked inkjet hole quickly and thoroughly in a short time, keep the cleanliness in the equipment, and retrieve and store the clean agent.

In one aspect, an ultrasonic cleaner configured to clean an inkjet head for ejecting an alignment solution is provided. The ultrasonic cleaner comprises a cleaning receiver for receiving a clean agent, and an ultrasonic generator for generating an ultrasonic, the ultrasonic generator is connected to the cleaning receiver, and the ultrasonic cleaner further comprises a storing device for retrieving and storing the clean agent, and the storing device is connected to the cleaning receiver.

In one embodiment, the storing device is an airtight box.

In one embodiment, the clean agent is a solvent in the alignment solution.

In one embodiment, the ultrasonic cleaner further comprises a pump connected between the cleaning receiver and the storing device, and the pump is configured to pump the clean agent into the cleaning receiver or the storing device.

In one embodiment, the storing device is made of stainless steel or PET.

In one embodiment, the ultrasonic generator comprises an ultrasonic power supply for generating a high-frequency alternating current, and an ultrasonic magnetic field generator for generating an ultrasonic vibration, and the ultrasonic magnetic field generator is electrically connected to the ultrasonic power supply.

In one embodiment, the vibrating frequency of the ultrasonic magnetic filed generator is higher than 20 KHz.

In another aspect, the disclosure further provides a coater equipped with the ultrasonic cleaner. The coater comprises:

an inkjet head for ejecting an alignment solution;

an ultrasonic cleaner for cleaning the inkjet head, wherein the ultrasonic cleaner includes a cleaning receiver for receiving a clean agent, an ultrasonic generator for generating an ultrasonic, and a storing device for retrieving and storing the clean agent, and each of the ultrasonic generator and the storing device is connected to the cleaning receiver; and a gearing device connected to the bottom of the ultrasonic cleaner, the gearing device is configured to control the movement of the ultrasonic cleaner and drive the ultrasonic cleaner to move vertically and horizontally.

In one embodiment, the storing device is an airtight box.

In one embodiment, the clean agent is a solvent in the alignment solution.

In one embodiment, the ultrasonic cleaner further comprises a pump connected between the cleaning receiver and the storing device, and the pump is configured to pump the clean agent into the cleaning receiver or the storing device.

In one embodiment, the storing device is made of stainless steel or PET.

In one embodiment, the ultrasonic generator comprises an ultrasonic power supply for generating a high-frequency alternating current, and an ultrasonic magnetic field generator for generating an ultrasonic vibration, and the ultrasonic magnetic field generator is electrically connected to the ultrasonic power supply.

In one embodiment, the vibrating frequency of the ultrasonic magnetic filed generator is higher than 20 KHz.

When implementing the invention, following advantages can be achieved. By using an ultrasonic generator together with a corresponding clean agent, a nozzle hole of a inkjet head which may be easily blocked can be cleaned quickly and thoroughly. In such case, the defects in the scrubbing method, comprising the inkjet head damage, the incomplete cleanliness and the long time consumption, can be overcame. As a result, the element damages in the equipment can be reduced, the productive efficiency and the quality of the product can be improved, the manufacturing cost can be reduced, and the brand value of the company and the competitiveness of the product can be enhanced. In addition, the ultrasonic cleaner in the disclosure can retrieve and store the clean agent to reduce the manufacturing cost, and thus avoiding the reduction of the cleanliness in the equipment in the scrubbing method or the immersing method.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

The ultrasonic cleaner in this disclosure is configured to clean the inkjet head, which is mainly used in the manufacturing of the liquid crystal display. In the disclosure, the ultrasonic cleaner can quickly and thoroughly clean the nozzle hole of an inkjet head which may be easily blocked. In such case, the defects in the scrubbing method or the immersing method, comprising the inkjet head damage, the incomplete cleanliness and the long time consumption, can be overcame. As a result, the element damages in the equipment can be reduced, the productive efficiency and the quality of the product can be improved, the manufacturing cost can be reduced, and the brand value of the company and the competitiveness of the product can be enhanced. In addition, the ultrasonic cleaner in the disclosure can retrieve and store the clean agent to reduce the manufacturing cost, and thus avoiding the reduction of the cleanliness in the equipment in the scrubbing method or the immersing method.

Figure 1:
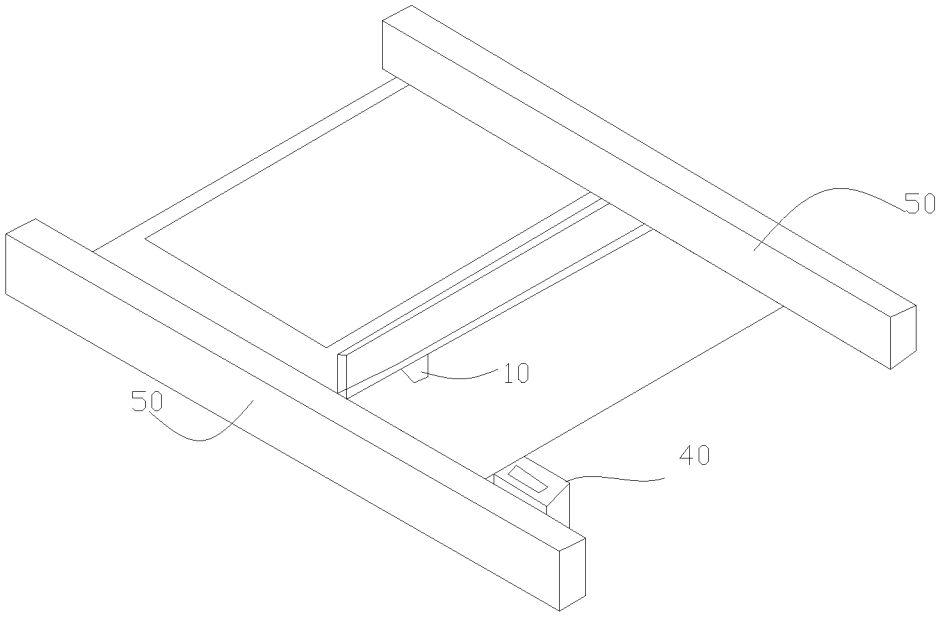
FIG. 1 is a schematic view of a coater equipped with an ultrasonic cleaner according to a preferred embodiment of the invention.

FIG. 1 shows a coater equipped with an ultrasonic cleaner. The coater comprises an inkjet head 10, a gearing device (not shown in FIG. 1 because the gearing device is shadowed) 20 a control system 30, an ultrasonic cleaner 40 and a pair of guide rails 50. The inkjet head 10 is configured to eject an alignment solution. The gearing device 20 may be any traditional device to drive the ultrasonic cleaner to move vertically and horizontally, such as an automatic motor, a semi-automatic motor, a stepping motor or the like. The inkjet head 10 is connected with the pair of guide rails 50. The inkjet head 10 can slide forward and backward on the guide rails 50. The gearing device 20 and the ultrasonic cleaner 40 are connected with each other by threaded connection so that the ultrasonic cleaner 40 can be driven to move. The ultrasonic cleaner 40 is located beneath an origin of a move path of the inkjet head 10 and the ultrasonic cleaner 40 aligns with the inkjet head 10. When the inkjet head 10 is blocked in the working process, the inkjet head 10 transmits a signal to the control system 30 of the coater. The control system 30 controls the gearing device 20 to move after receiving the signal, in order to drive the ultrasonic cleaner 40 to move to a position that is right beneath the inkjet head 10, and to make the inkjet head 10 partially immerse in the clean agent received in the ultrasonic cleaner 40 to clean the inkjet head 10. However, in other embodiments, the inkjet head 10 can be controlled to move to a position that is above the ultrasonic cleaner 40, and to be partially immersed in the clean agent received in the ultrasonic cleaner 40.

Figure 2:
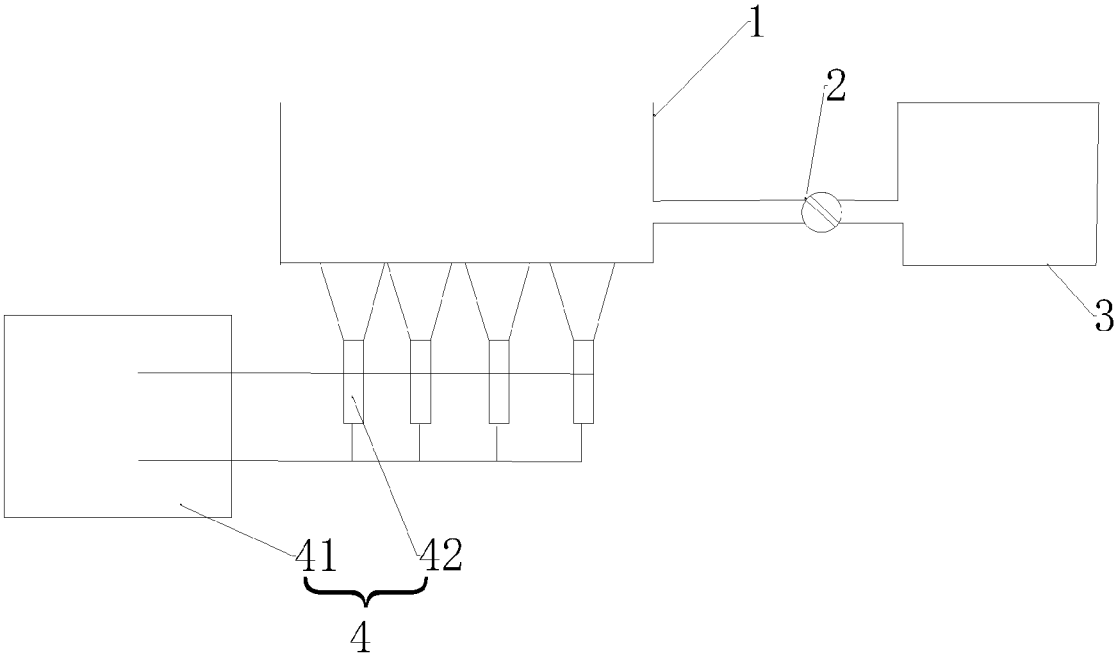
FIG. 2 is a schematic view of an ultrasonic cleaner according to the invention.
Figure 3:
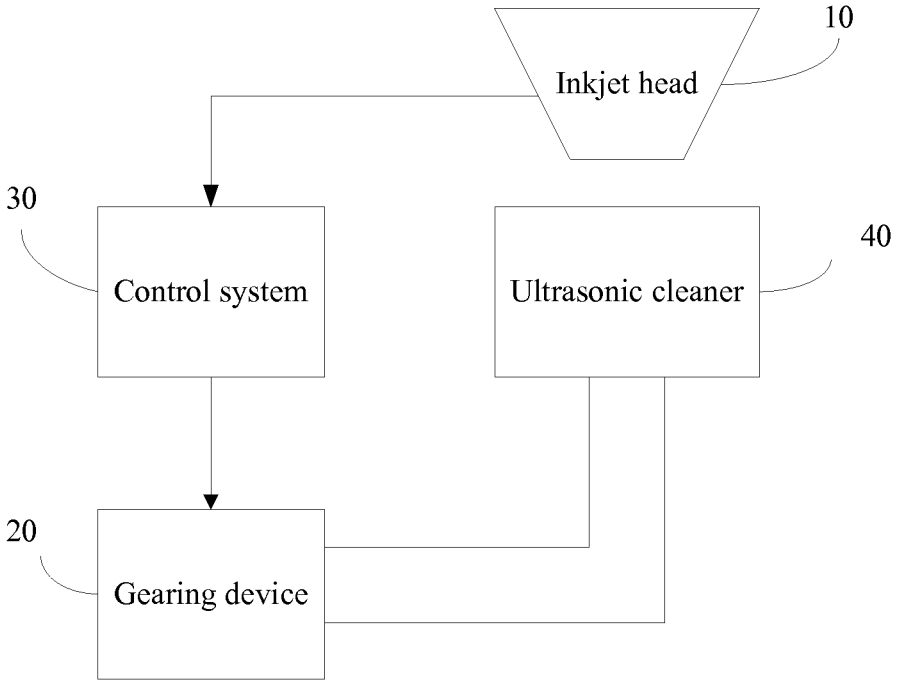
FIG. 3 is a schematic view of a driving system of the coater shown in FIG. 1.

FIG. 2 shows an ultrasonic cleaner. The ultrasonic cleaner comprises a cleaning receiver 1, a pump 2, a storing device 3 and an ultrasonic generator 4. The cleaning receiver 1 is configured to receive the clean agent. The storing device 3 is configured to retrieve and store the cleaning agent. The ultrasonic generator 4 is configured to generate an ultrasonic. The pump 2 may be a water pump, a hydraulic pump or the like, which is configured to pump the clean agent from the storing device 3 into the cleaning receiver 1 while cleaning, and pump the clean agent from the cleaning receiver 1 into the storing device 3 for storing after cleaning. The ultrasonic generator 4 is connected to the cleaning receiver 1. The cleaning receiver 1 is communicated with the storing device 3 through the pump 2 and pipelines. In other embodiments, the pump 2 can be omitted. The ultrasonic generator 4 comprises an ultrasonic power supply 41 for generating a high-frequency alternating current and an ultrasonic magnetic field generator 42 for generating an ultrasonic vibration. The ultrasonic power supply 41 is electrically connected to the ultrasonic magnetic field generator 42.

The principle of the ultrasonic cleaner will be explained in detail in the following.

When the inkjet head 10 is blocked, the ultrasonic cleaner 40 moves to a position that is right beneath the inkjet head 10, and the inkjet head 10 is partially immersed in the clean agent received in the ultrasonic cleaner 40. The ultrasonic power supply 41 is put on to convert the industrial electricity into a high-frequency alternating current and supply the converted high-frequency alternating current to the ultrasonic magnetic field generator 42. The ultrasonic magnetic field generator 42 converts the electricity energy into the ultrasonic mechanical energy, and further transmits the mechanical energy into the clean agent received in the cleaning receiver 1. The blocked part of the inkjet head 10 is immersed in the clean agent. The substance blocked in the inkjet head 10 is dissolved in the clean agent under the effect of the ultrasonic vibration. In such case, the inkjet head 10 can be cleaned quickly and thoroughly. After the inkjet head 10 is cleaned, the pump 2 is put on to pump the clean agent back to the storing device 3 in order to store the clean agent for next time.

In order to avoid the inkjet head 10 and the alignment solution from being polluted, the clean agent is the solvent in the alignment solution.

Because the solvent in the alignment solution is generally easy to be volatile, the storing device 3 is an airtight box if choosing the solvent or other volatile solvent as the clean agent, so as to economize the clean agent and avoid the safety accident due to the volatile solvent.

Because the clean agent is the solvent in the alignment solution, the material of the storing device 3 and the material of the cleaning receiver 1 are specially chosen, namely the materials are not immiscible with the solvent. In the embodiment, the storing device 3 and the cleaning receiver 1 are made of stainless steel or PET (Polyethylene terephthalate).

In order to shorten the time for cleaning the inkjet head and strengthen the effect of cleaning, the vibration frequency of the ultrasonic magnetic field generator is preferably higher than 20 KHz.

While the present invention has been described by reference to preferred embodiments, it will be understood by those skilled in the art that various changes may be made and equivalents may be substituted without departing from the scope of the present invention. However, all the changes will be included within the scope of the appended claims.

The invention claimed is:

1. A coater, comprising:

an inkjet head for ejecting an alignment solution;

an ultrasonic cleaner for cleaning the inkjet head, wherein the ultrasonic cleaner includes a cleaning receiver for receiving a clean agent, an ultrasonic generator for generating an ultrasonic, a storing device for retrieving and storing the clean agent, wherein each of the ultrasonic generator and the storing device is connected to the cleaning receiver, a pump connected between the cleaning receiver and the storing device, wherein the pump is configured to pump the clean agent into the cleaning receiver or the storing device;

a gearing device connected to the bottom of the ultrasonic cleaner, wherein the gearing device is configured to control the movement of the ultrasonic cleaner and drive the ultrasonic cleaner to move vertically and horizontally; and a control system electrically connected to the inkjet head and the gearing device, wherein the control system is configured to receive a signal from the inkjet head when the inkjet head is blocked in the working process and to control the gearing device to move after receiving the signal;

wherein the clean agent is a solvent of the alignment solution;

and wherein the storing device is an airtight box.

2. The coater of claim 1, wherein, the storing device is made of stainless steel or PET.

3. The coater of claim 1, wherein, the ultrasonic generator includes an ultrasonic power supply for generating a high-frequency alternating current and an ultrasonic magnetic field generator for generating an ultrasonic vibration, and the ultrasonic magnetic field generator is electrically connected to the ultrasonic power supply.

4. The coater of claim 3, wherein, a vibration frequency of the ultrasonic magnetic field generator is higher than 20 KHz.

* * * * *